United States Patent [19]

Dunsmoor

[11] Patent Number: 4,558,536

[45] Date of Patent: Dec. 17, 1985

[54] WINDOW CONSTRUCTION

[75] Inventor: Forrest L. Dunsmoor, Atlanta, Ga.

[73] Assignee: Peachtree Doors, Inc., Norcross, Ga.

[21] Appl. No.: 608,417

[22] Filed: May 9, 1984

[51] Int. Cl.[4] ..... E05D 15/16

[52] U.S. Cl. ..... 49/404; 49/62; 49/446; 49/454; 49/501; 49/504; 49/506; 52/456; 52/507

[58] Field of Search ..... 49/404, 445, 446, 454, 49/453, 456, 457, 501, 504, 505, 506, 61, 62; 52/507, 456

[56] References Cited

U.S. PATENT DOCUMENTS

| | | | |
|---|---|---|---|
| 300,881 | 6/1884 | Masters | 160/101 |
| 1,718,813 | 6/1929 | Finley | 49/505 |
| 1,724,186 | 8/1929 | Fox | 49/505 X |
| 2,453,992 | 11/1948 | Kleintop | 160/182 |
| 2,595,506 | 5/1952 | Backman | 49/505 X |
| 2,681,481 | 6/1954 | Mason | 49/62 X |
| 2,761,173 | 9/1956 | Dinsmore | 49/445 X |
| 2,871,506 | 2/1959 | Decker et al. | 49/445 X |
| 3,307,316 | 3/1967 | Gray | 52/507 |
| 3,358,404 | 12/1967 | Dinsmore | 49/446 |
| 3,449,862 | 6/1969 | Biro | 49/453 X |
| 3,686,814 | 8/1972 | Anderson | 52/207 X |
| 3,815,285 | 6/1974 | Kuyper | 49/501 |
| 4,122,633 | 10/1978 | Holdiman | 49/504 X |
| 4,238,907 | 12/1980 | Swan | 49/404 X |
| 4,437,284 | 3/1984 | Cribben et al. | 52/456 |
| 4,479,331 | 10/1984 | Bertolami et al. | 49/404 |

*Primary Examiner*—Philip C. Kannan

*Attorney, Agent, or Firm*—Kimmel, Crowell & Weaver

[57] ABSTRACT

An improved window construction including a combination metal/wood support frame for a double hung metal window sash, the metal window sash being provided with side channels for reception of counterbalance springs therein. A screw-threaded bow adjuster is provided which is usable for installing the combination wood/metal frame in the house framing for eliminating any bow therebetween to reduce heat losses therethrough. A wood sash liner/fascia is provided for covering the metal window to give same the over-all appearance of a window made entirely of wood. The wood sash liner/fascia preferably being provided with a plurality of muntins thereacross which are joined with tongue and groove type joints. The top horizontal bar of the bottom window being provided with a lock covering recess and the lower horizontal bar thereof having hand-recess cut-outs. Both the upper and lower metal window sash being provided with a vertical recess at each side thereof for receiving insulating and weather stripping attachment/mounting strips between the metal/wood support frame and the metal window for retaining the metal window affixed to the support frame. Apertures are also provided in the wood covering liner/fascia for receiving attachment screws or the like to secure the installed covering over the metal window and thereby prevent removal of the insulating, weather stripping installation strips to prevent removal of the metal window from the combination metal/wood support frame, and also to give the outward appearance of an all-wood window.

24 Claims, 15 Drawing Figures

S
FW
147
94
190
194
160
27
247
90
193
92
93
17
174
VOID
G
54
53
59
56
57
A
50
52
24
12
2
4A

WINDOW CONSTRUCTION

BACKGROUND OF THE INVENTION

1. Field of the Invention

This invention relates generally to window construction and especially to such construction involving aluminum windows with covering structure to give the appearance thereto of a wood window.

2. Description of the Prior Art

A common problem with known devices for simulating wooden windows by covering metal windows with various overlays is that the specific construction and arrangement thereof is generally very complicated, and the attachment and fastening structure is not quite satisfactory.

Also, the manner of mounting the necessary balance spring structure for the original metal window often times leaves much to be desired.

Furthermore, the known methods of mounting metal windows in window jambs often times omits any insulating or weather stripping structures and/or is inadequate resulting in a greater amount of heat loss than is desired.

Also, structure for adjusting a window to make sure that the window is mounted correctly and that the weather stripping, as preferably used, functions as it should is often lacking. Provision of structure for eliminating any bowing of the window frame so that there will be no perceptible or substantial air leakage or heat loss thereby is highly desirable.

Existing prior art patents which may be pertinent to the present invention are as follows:

| Patent No. | Inventor | Issue Date |
|---|---|---|
| 300,881 | Masters | 6/23/1884 |
| 1,718,813 | Finley | 6/25/29 |
| 2,453,992 | Kleintop | 11/16/48 |
| 3,307,316 | Gray | 3/7/67 |
| 3,358,404 | Dinsmore | 12/19/67 |
| 3,449,862 | Biro | 6/17/69 |

The patent to Kleintop is of general interest as it relates to an auxiliary frame and sash which is adapted to be secured to the exterior surface of a conventional window frame, and is provided with means for mounting an upper and lower storm sash. However, the purpose and the structural aspects of this patent disclosure are entirely different from the current invention.

The patent to Gray does relate to an arrangement for mounting muntins in a window, and discloses on Page 2 of the drawings the manner in which the extruded muntins are assembled, and, after assembly, how they are mounted to the wooden frame itself through the medium of the connector pins shown in FIGS. 9 and 10. This patent is of general interest only.

The Dinsmore U.S. Pat. No. 3,358,404 discloses a metal frame window sash provided with an outwardly extending groove in which is mounted a spring balance arrangement.

The Biro U.S. Pat. No. 3,449,862 discloses vertically slidable sashes, the sashes being formed with outwardly facing grooves in the side elements, and the grooves being adapted to receive spring balancing structures similar to those utilized by the present invention. Centering structure for the sashes of the Biro device are also disclosed. However, the overall arrangement of this patented device is substantially different from that of the present invention.

The Masters U.S. Pat. No. 300,881 discloses structure for positioning a window screen in a window between two sliding sashes. In order to maintain the screen in position, a parting strip C is utilized, which is positioned between the two slidable sashes. This parting strip at first appears to be somewhat similar to the weather stripping retention structure of the present invention, but actually is quite different therefrom.

The Finley U.S. Pat. No. 1,718,813 discloses a captured bolt which is adapted to be adjusted by a screwdriver to facilitate mounting a door jamb in the vertical position. However, the use of this disclosure is substantially different from that of the adjustable metal window frame within outer frame structure of the present invention.

In summary, none of the known prior art devices offer the new and novel features of the present invention.

SUMMARY OF THE INVENTION

An object of the present invention is to provide a wood sash liner which is constructed and arranged for easy covering and affixing to a metal, double hung, window thereunder. The liner is designed to conceal the conventional window lock of the metal window sash, and also has specific weather stripping structure for holding the parts together. The window sash liner also is specifically constructed with appropriate hand hold recesses and a desired number of muntins.

A further object of the present invention is in the method of mounting a balance spring for the metal window within a channel of each such window.

A still further object of the present invention is to provide an improved method of mounting a window in a window jamb in such a manner that the window is held in the frame through the medium of weather stripping units, together with structure for adjusting the window itself to the window frame to eliminate any bowing therebetween for eliminating air leakage and heat losses therethrough.

A still further object of the present invention is to provide an improved window covering which can be easily installed over metal windows to give the appearance thereto of a wood window, together with suitable adjusting and weather stripping structures for reducing heat loss through the window structure.

An important feature of the present construction is the utilization of an extruded aluminum frame which holds the window glass itself, and which frame is mounted in an extended aluminum framing and held in place through the utilization of removable insulation elements. The aluminum facing of the window on the interior side of the room is itself covered by a wooden sash liner which is preformed and which, because of its specific construction, is adapted to be attached to the aluminum glass frames in such a manner that the aluminum is completely hidden, and that the appearance of the window from the interior of the room is that of a conventional wooden sliding sash window and frame.

Preferably, the wooden sash liner is formed in such a manner that muntins can be utilized therewith, if desired, or the wooden frame itself can be utilized without the muntins. Also, the upper portion of the wood liner is so formed that it completely hides from view the latch mechanism of the metal window when the wooden covering is in position on the metal window.

Another feature comprises the manner in which a spring balance element is effectively mounted in the double hung window sash itself, and not in the window frame as is normally found in the art. To achieve this, the extruded aluminum frame which carries the glass is provided with a longitudinally extending channel into which the balance element is concealed and is retained in position, and a Polyester cord associated with the spring element in the sash is attached to an aperture in the frame of the window jamb itself, thus effectively providing a balance for the sliding sash window. If required, two spring balancing elements can be mounted in each window sash to provide for effective movement of the sash from closed to open position.

The next feature is the manner in which the aluminum frame holding the window glass is mounted in the jamb itself through the utilization of longitudinally slidable and removable insulation elements which cooperate with grooves formed in the aluminum window frame and with grooves provided in the window jamb, in such a manner that, once the insulation elements have been positioned in both the window frame grooves and in the window jamb itself and then moved downwardly, the window is effectively locked and held in position through the insulation elements.

A further element which is important is the manner in which the window frame itself is adjusted to be sure that no bowing will be found in the completed unit, and to assure that the insulation elements are in close fitting arrangement with the frame itself, thus assuring that there will be no air leakage by these elements. This is accomplished through the utilization of a captive screw threaded adjustor which is mounted in the window jamb per se, preferably in a drilled hole in the wooden frame, and operates in such a manner that the jamb itself can be adjusted inwardly or outwardly to assure a perfect fit against the surrounding insulation and outer building structure.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
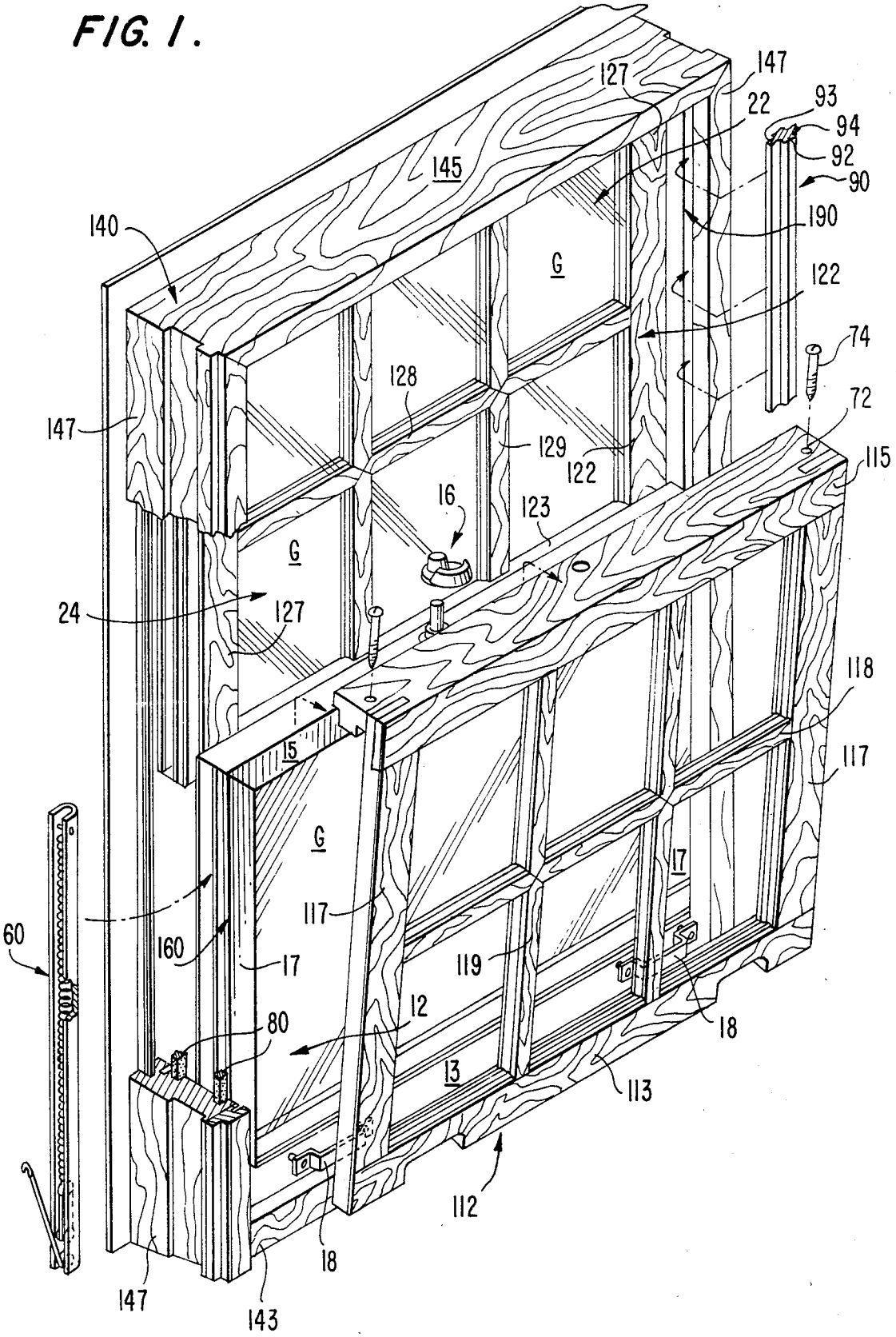
FIG. 1 is a perspective view of the present invention with the upper metal window sash being covered with a wood covering liner/fascia and the lower metal window sash having the wood covering liner/fascia partially removed therefrom and ready for installation thereon.

Referring to FIG. 1 of the drawing, reference numeral 10 indicates in general the improved window construction of the present invention.

Figure 2:
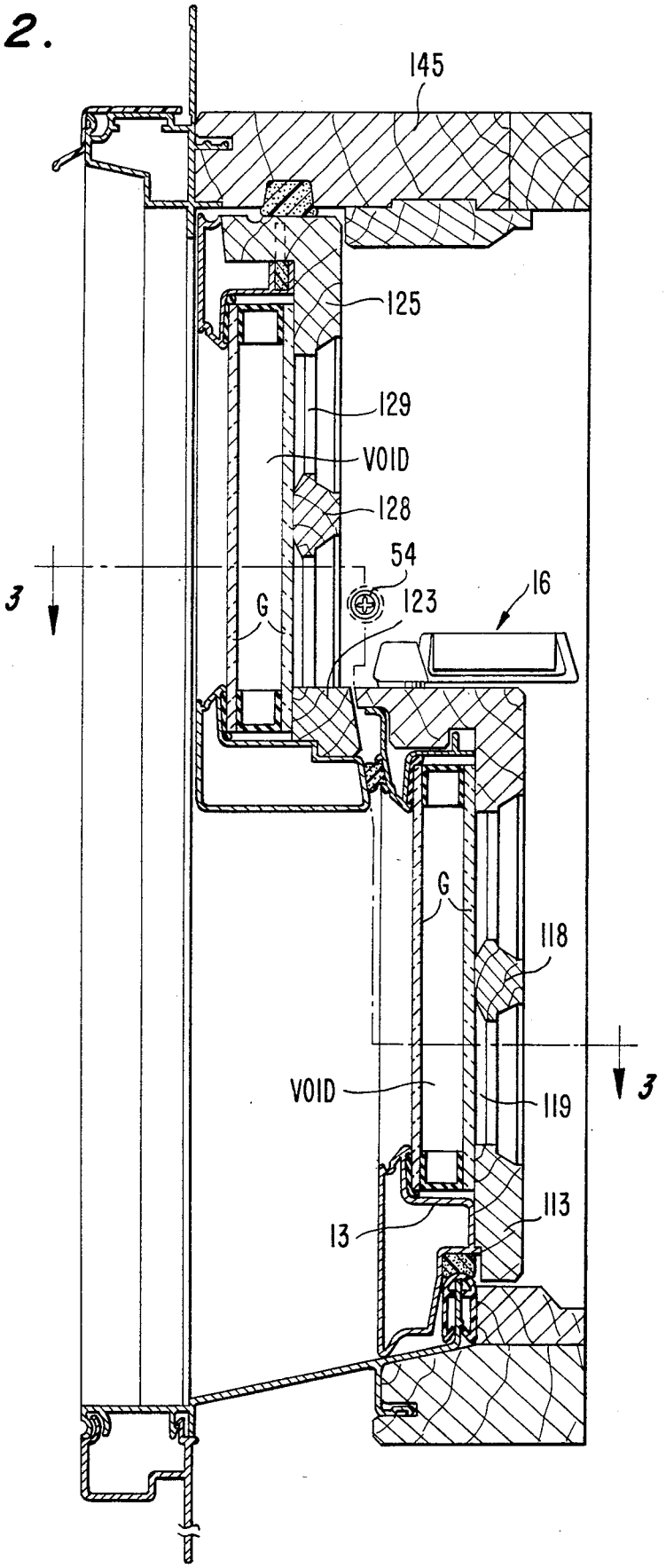
FIG. 2 is a vertical cross-sectional view through the mid-section of the, window after the wood covering liners/fascias have been installed therewith.
Figures 3, 4A, 4B:
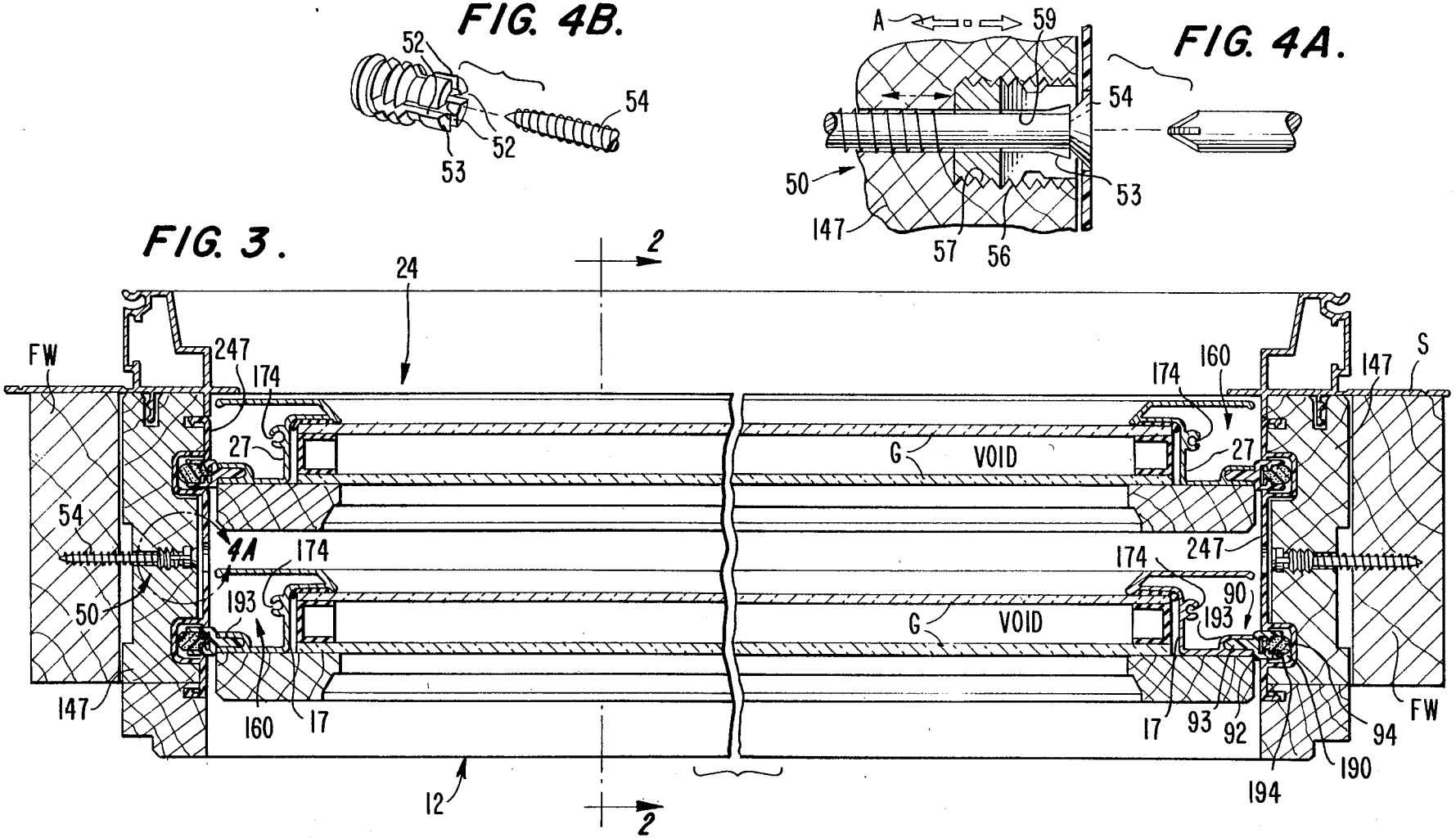
FIG. 3 is a horizontal cross-sectional view taken along lines 3—3 of FIG. 2.
FIGS. 4A and 4B are enlarged detail views of the encircled area No. 4 of FIG. 3 showing the jamb and window adjustment structure.
Figure 5:
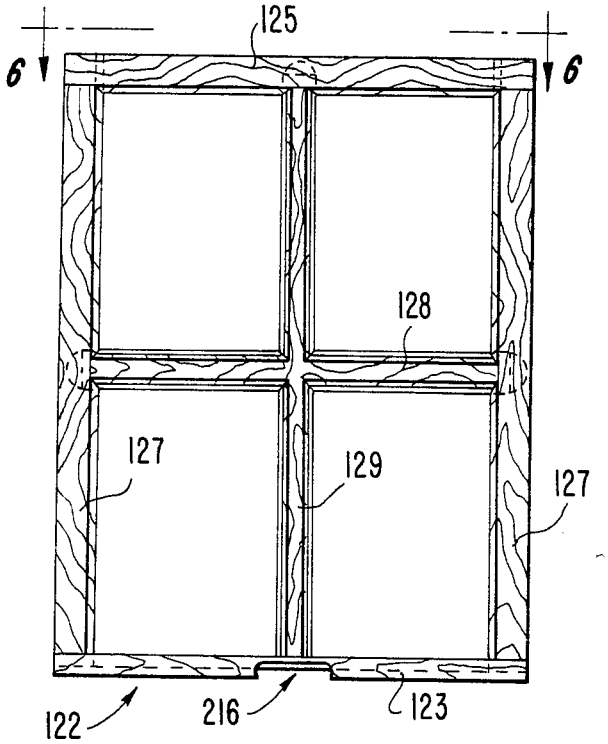
FIG. 5 is an elevational view of the upper sash as covered with the wood liner/fascia structure.

Looking at FIGS. 1, 2 and 3, the detailed features of the present invention will be described. The purpose of this invention is to give the appearance of a wood window to a metal window, and simultaneously to prevent the double hung metal window sash from being removed from the outside support frame therefor. The lower metal window sash is indicated by 12 and the upper window sash by 22. Each of these metal sashes has double panes of glass G containing a void therebetween for the insulating properties thereof. The lower metal window sash has a bottom horizontal bar 13, a top horizontal bar 15, and vertical side risers 17. Each side riser 17 is provided with a channel 160 therein for reception of spring type counterbalance structure 60 within the window sash itself rather than in the outer frame, which is the conventional manner of installing such counterbalance spring. The top metal window sash 24 has a lower horizontal bar 23, a top horizontal bar 25 and vertical side risers 27. Again, suitable channels 160 are provided for spring counterbalance structure 60 for the upper metal window sash.

A wood covering liner/fascia 112 is provided for the lower metal window sash. This liner/fascia has a horizontal bottom rail 113, a horizontal top rail 115, and vertical side risers 117. Muntins 118 and 119 also are preferably added between the vertical and horizontal elements as best seen in the perspective of FIG. 1.

The top metal window is suitably covered by a wood covering liner/fascia 122 having a lower horizontal rail 123, an upper horizontal rail 125, and vertical risers 127. Again, horizontal muntins 128 and vertical muntins 129 are preferably provided. In FIG. 1, the top liner/fascia is shown already installed, while the lower liner/fascia is in a position ready for installation.

An outer combination wood/metal window frame 140 is also provided. This window frame has a top horizontal header 145, a bottom sill element 143, and vertical risers 147. As best seen in FIG. 3, the inside of the vertical risers 147 are suitably faced with metal coverings 247. Likewise, although not shown, the lower sill 143 and the upper header 145 are likewise covered with a suitable metal (preferably aluminum) facing.

During initial installation of the double hung metal window and the combination wood/metal outer frame therefor, the outer frame is placed into position within the framework FW of a building. This may be during the initial construction of the building, or a retrofit for windows previously installed and which have been removed. The framework FW is according to code and of conventional framing construction. Aluminum siding S is also shown on the outside surface of the building. During installation of the outer wood/metal framework for the metal window, bow adjusters 50 are preferably installed. This adjuster is shown in greater detail in FIGS. 4A and 4B of the drawings. A head adjuster unit 52, provided with suitable tool engaging slots 53 therein, is mounted within a predrilled, pre-threaded aperture in each of the vertical risers 147 of the frame. A self-threading Phillips head screw 54 passes through an aperture 59 within the adjuster head and screws into the building framework FW. External threads 56 on the head adjuster 52 permits the adjuster 52 to be turned in either direction and correspondingly move the vertical risers 147 inwardly or outwardly of the building framework as indicated by double headed arrow A in FIG. 4A. By use of one or more of these adjusters on each side of the window frame, any bow that might exist, either inwardly or outwardly, between the vertical risers 147 and the building framework FW, can be compensated for and eliminated. Thus, maximum prevention of heat loss alongside the window frame can be adjusted for.

Another very important feature of the present invention is the method of installing the metal window sash so that it can be easily removed entirely from the combination wood/metal frame when it is desired to do so. For example, when it is desired to wash both the inside and outside of the window glass, etc.

The structure for effecting this desirable function are the insulating and holding strips 90 best seen in FIG. 1. Each strip 90 is approximately the same length as the height of the window it is to hold and comprises a T-shaped strip in cross-section, including stem 93 and head cross portion 92. An insulating strip 94 is preferably affixed in a groove 194 in the outside surface of the head cross portion 92. Channels 190 are provided within the combination wood/metal window frame for reception of the T head 92 and insulating strip 94 therewithin. The stem 93 of the strip correspondingly fits into a channel 193 formed along the vertical risers of each metal window sash. Thus, as can be easily visualized by looking at FIGS. 1 and 3, when it is desired to install the metal window sash, the spring balancers 60 are first put into place, then the insulating and holding strips 90 are slid downwardly into place and, thus, interlock the metal window within the combination metal/-wood window frame. In order to prevent removal of these holding strips 90, the wood covering liner/fascias 112 and 122 are promptly installed thereover. Apertures 72, shown in the top horizontal rail 115 of the liner/-fascia 112 of FIG. 1, receive self-threading metal screws 74 therethrough, which, correspondingly, screw into the channel 174 of the metal window sash. Thus, after the metal window sash has been fixed in place by the holding strips 90, the liner/fascia coverings are fastened in place and thereby lock the strips against removal until such later time as the wood coverings are detached and removed.

Figure 7:
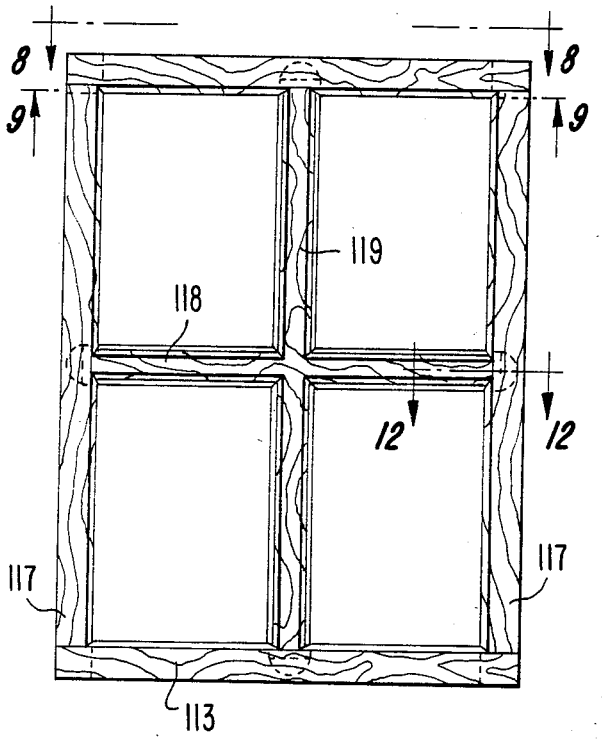
FIG. 7 is an elevational view of the lower sash as covered with the wood liner/fascia of the present invention.
Figure 6:
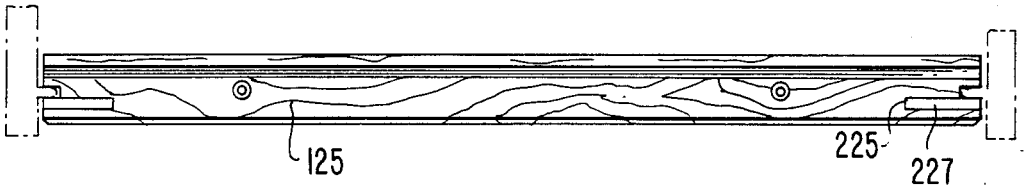
FIG. 6 is a top plan view of the upper sash taken along lines 6—6 of FIG. 5.
Figure 8:
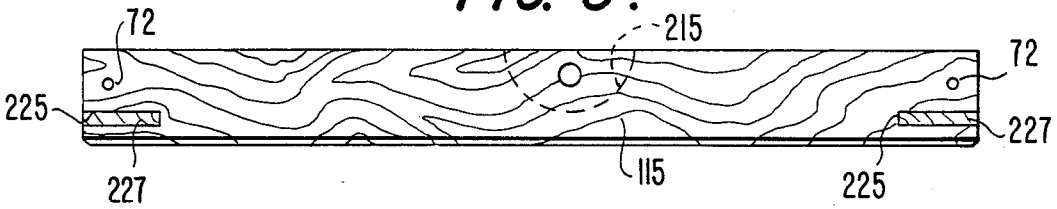
FIG. 8 is a top plan view of the lower sash taken along lines 8—8 of FIG. 7.
Figure 9:
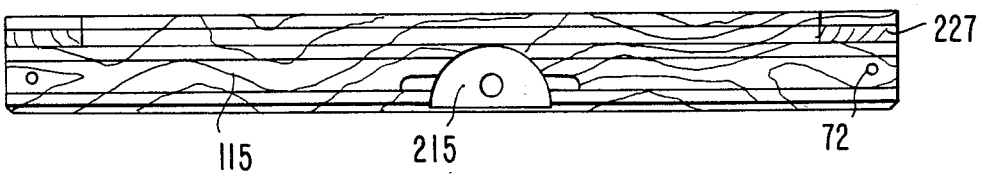
FIG. 9 is a cross-sectional view taken along lines 9—9 of FIG. 7 showing the bottom portion with lock recess of the midrail (top rail of lower sash) of FIG. 7.
Figure 10:
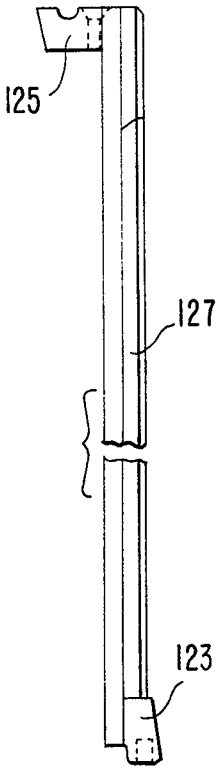
FIG. 10 a side elevational view of the upper sash of FIG. 5.
Figure 11:
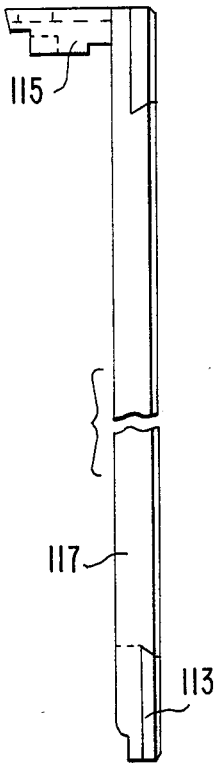
FIG. 11 a side elevational view of the lower ash of FIG. 7.
Figure 12:
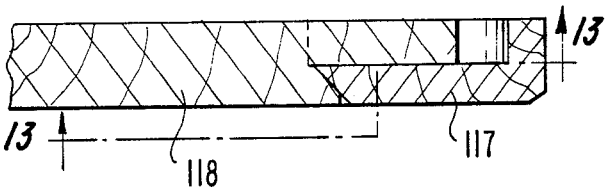
FIG. 12 is an enlarged detail, in cross-section, taken along lines 12—12 of FIG. 7, showing the muntin joint construction for the wood covering liner/fascia of the present invention.
Figure 13:
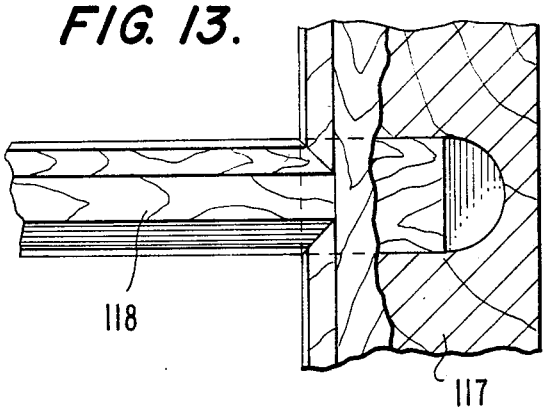
FIG. 13 is an elevational view showing the muntin joint of FIG. 12.

FIGS. 5–14 show various features of the construction of the wood covering liner/fascia per se. Their respective upper and lower horizontal bars, their vertical risers, and the muntins are all clearly shown and have the same reference numerals as already described. In addition, it should be noted that the upper horizontal rail 115 of the lower sash covering, shown in FIGS. 7 and 8, is provided with a recess 215 for covering the metal window lock 16. Also, a recess 216 is suitably provided in the lower horizontal bar 123 of the upper sash (FIG. 5), for the same lock. FIG. 9 shows, from the bottom, the lock recess 215 in the upper rail of the lower covering fascia. Grooves 223 and tongues 227 are provided for the respective corners of the wood covering liner/fascia to hold the elements appropriately together. Suitable glue or the like, or other fasteners, also can be added as needed or desired.

Figure 14:
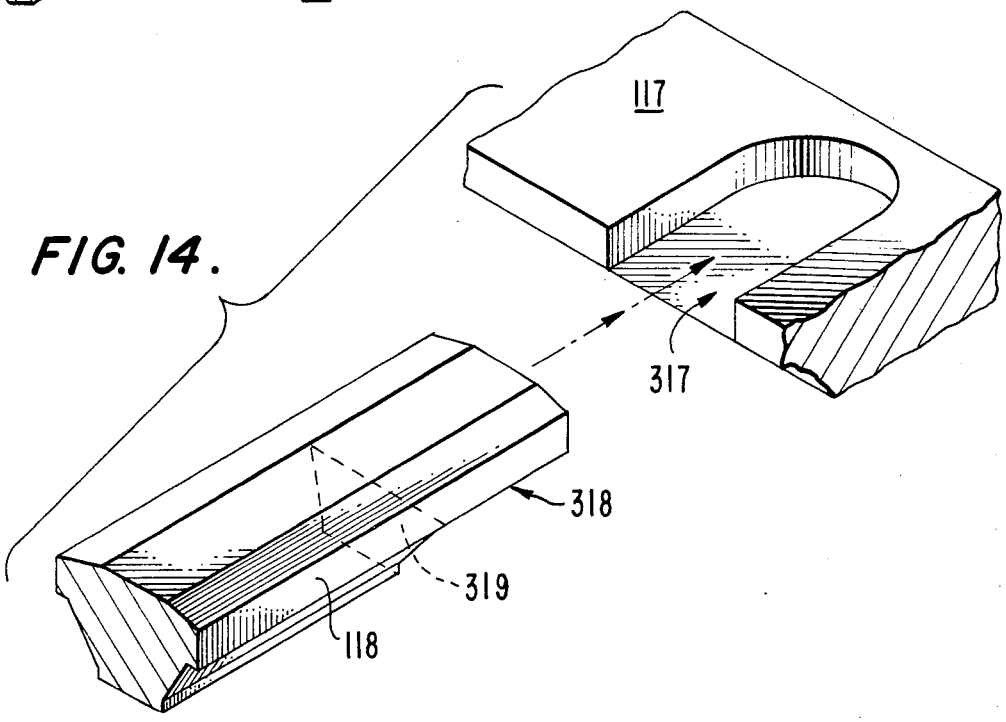
FIG. 14 is a detailed fragmentary perspective view of the muntin to rail interfit with the rear surface of the muntin and rail being shown.

It is highly desirable that muntins between the rails and risers be used. The muntins are recessed at each end of a rear surface thereof, as best seen in the perspective of FIG. 14 (see the recess 318 and center shoulder 319 at the end of the front of the muntin). Recesses 317 are appropriately cut into the vertical side rails 117, as shown in FIG. 4, for reception of the muntin end therewithin. While the connections of the upper rails and the corresponding muntins therewith are not shown, they correspond in detail to the showing in FIG. 14.

The present invention has a number of new and novel features. Very important are that the wood covering liner/fascial has a dual purpose in that it gives the outward appearance of a wood window to a metal window, and also has a very important utilitarian function in that it locks the holding strips 90 into place between the channels within the metal window sash and their corresponding channels within the outer combination wood/metal frame. Also, the adjusting bow head and screw structure and the method of joining the wood pieces together are important features of the present invention.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A window construction comprising:

a combination wood/metal frame mountable in the framework of a building;

a metal double hung window being removably mounted in said wood/metal frame by insulating mounting strips; and a wood liner/fascia attachable to said metal window to give the appearance thereto of a wood window and which also prevents removal of said insulating mounting strips to prevent disassociation of said metal window from said combination wood/metal frame.

2. The window construction of claim 1, wherein said metal window includes a window lock, and said wood liner/fascia is designed to conceal said lock from view.

3. The window construction of claim 2, wherein said wood liner/fascia further includes at least one set of muntins.

4. The window construction of claim 1, wherein said wood liner/fascia further includes at least one set of muntins.

5. The window construction of claim 4, wherein said wood liner/fascia includes a plurality of wood cross pieces with one of same being provided with apertures therein for receiving fastening means for fixing the wood liner/fascia to the metal window as installed thereupon.

6. The method of installing a wood covering over a metal window including the steps of:

placing a metal window into a support frame both of which are provided with longitudinal recesses substantially the full length thereof;

inserting insulating and mounting weather strips into place between adjacent recesses in said metal window and said support frame for holding the two together; and affixing structure to at least one of the aforesaid to prevent removal of the insulating and mounting weather strips and thereby prevent disassociation of the metal window from the frame.

7. The method of claim 6, wherein said structure has a wood facing so as to cover the metal window and thereby give the appearance thereto of a wood window, and further including the step of applying fasteners between the wood facing structure and said metal window.

8. The method of claim 7, further providing at least one aperture in said wood covering structure for receiving replaceable fastening structure therethrough for attachment of said wood covering to said metal window, and the step of inserting the fastening structure through said aperture into the metal window.

9. The method of claim 8, including the further step of adjusting pre-installed adjusting frame structure in the support frame so any bow between same and a building support framework can be compensated for during initial installation of the window support frame.

10. The method of claim 9, wherein a balance spring is additionally installed in a channel provided in the metal window.

11. A window construction for buildings and the like comprising:

a combination wood/metal support frame;

a metal window of double hung type configuration for mounting within said combination wood/metal support frame;

mounting strip means for replaceably installing said metal window within said wood/metal frame; and wood covering means for mounting over the metal window to give same the appearance of a wood window and simultaneously preventing removal of said mounting strip means to prevent disassociation of said metal window from said frame.

12. The window construction of claim 11, together with further means for providing a counterbalance for said metal window.

13. The window construction of claim 12, wherein said further means for providing a counterbalance includes a spring balance structure installed within a channel provided in said metal window.

14. The window construction of claim 13, together with additional means for compensating for any bow of said wood/metal support frame as installed in a building framework.

15. The window construction of claim 14, wherein said additional means include a compensating screw-threaded adjuster head and an affixing screw therethrough which provides for such compensating adjustment.

16. The window construction of claim 11, wherein said wood covering means includes a wood lining/fascia framework having at least one muntin therewith.

17. The window construction of claim 16, together with said lining/fascia framework having a plurality of said muntins, and said metal window is free of any muntins whatsoever in its uncovered state so that by adding the wood covering means the overall window appearance is substantially changed.

18. The window construction of claim 16, wherein at least one of said muntins is undercut at each of the end portions of the muntin which fit into recesses provided in said wood framework.

19. A wood covering for a metal window to give an appearance thereto of a wood window comprising:

a top horizontal bar, a lower horizontal bar, side vertical pieces connected between the respective ends of said top bar and said lower bar for forming a rectangular wood window covering, and at least one muntin extending between respective portions of said covering, with the respective ends thereof undercut for reception within appropriate recesses provided in said respective portions of said covering.

20. The wood covering of claim 19, wherein the lower horizontal bar has window handle cut-outs provided therethrough, and the top horizontal bar has a lock mechanism recess provided therein.

21. A window device comprising:

an outer frame mountable in a construction framework of a building;

a metal double hung window for removable mounting in said outer frame;

retainer strip means for holding said metal window together with said outer frame; and a wood fascia means affixable on said metal window for preventing removal of said retainer strip means to prevent disassociation of said metal window from said outer frame and in addition to give an appearance thereto of a wood window.

22. The window construction of claim 21, wherein said wood fascia means includes at least one set of muntins.

23. The window construction of claim 21, wherein said wood fascia means includes a plurality of wood cross pieces with one of same being provided with apertures therein for receiving fastening means for fixing the wood fascia means to the metal window as installed thereupon.

24. The window construction of claim 21, wherein said metal window includes a window lock, and said wood fascia means also functions to conceal said lock from view.

* * * * *